US007132917B2

(12) United States Patent
Kojima et al.

(10) Patent No.: US 7,132,917 B2
(45) Date of Patent: Nov. 7, 2006

(54) IGNITION COIL HAVING SECONDARY COIL ASSEMBLY AND CONNECTING METHOD FOR THE SAME

(75) Inventors: Masami Kojima, Chiryu (JP); Masahiko Aoyama, Kariya (JP); Takanori Suekane, Inabe-gun (JP); Shoichi Takeyama, Hashima (JP); Hideyuki Kato, Nishio (JP)

(73) Assignee: Denso Corporation (JP)

( * ) Notice: Subject to any disclaimer, the term of this patent is extended or adjusted under 35 U.S.C. 154(b) by 68 days.

(21) Appl. No.: 11/019,945

(22) Filed: Dec. 23, 2004

(65) Prior Publication Data

US 2005/0140481 A1 Jun. 30, 2005

(30) Foreign Application Priority Data

Dec. 24, 2003 (JP) ..... 2003-427520
Nov. 8, 2004 (JP) ..... 2004-324218

(51) Int. Cl.
*H01F 27/02* (2006.01)

(52) U.S. Cl. ..... 336/90; 336/96; 336/92

(58) Field of Classification Search ..... 336/192, 336/92, 90, 96, 60; 123/634–635
See application file for complete search history.

(56) References Cited

U.S. PATENT DOCUMENTS 4,392,473 A * 7/1983 Tsutsui et al. ..... 123/635
5,912,517 A * 6/1999 Nishimura et al. ..... 310/71
5,927,259 A * 7/1999 Ando et al. ..... 123/634
6,522,232 B1 * 2/2003 Paul et al. ..... 336/96
6,639,171 B1 10/2003 Tsuge ..... 219/56.33
6,836,203 B1 * 12/2004 Wada ..... 336/198
6,882,785 B1 * 4/2005 Eichelberger et al. ..... 385/101

FOREIGN PATENT DOCUMENTS

JP 2001-87854 4/2001

* cited by examiner

*Primary Examiner*—Anh Mai
(74) *Attorney, Agent, or Firm*—Nixon & Vanderhye PC

(57) ABSTRACT

An ignition coil includes a center core, a secondary coil, a primary coil, and an outer core. The secondary coil and the primary coil are substantially coaxially arranged on the outer circumferential side of the center core. The secondary coil includes a secondary winding that is wound around a secondary spool. The secondary spool has a high voltage bracket that includes a secondary terminal. The primary coil includes a primary winding that is wound around a primary spool. The outer core is arranged on the outer circumferential side in the ignition coil. The secondary terminal includes a first connecting portion, which is in a bulb shape, in the tip end. The first connecting portion connects with an end portion of the secondary winding. The first connecting portion is covered with an electrically insulative resin.

27 Claims, 5 Drawing Sheets

IGNITION COIL HAVING SECONDARY COIL ASSEMBLY AND CONNECTING METHOD FOR THE SAME

CROSS REFERENCE TO RELATED APPLICATIONS

This application is based on and incorporates herein by reference Japanese Patent Applications No. 2003-427520 filed on Dec. 24, 2003 and No. 2004-324218 filed on Nov. 8, 2004.

FIELD OF THE INVENTION

The present invention relates to an ignition coil that has a second coil assembly, and a connecting method of the second coil assembly.

BACKGROUND OF THE INVENTION

An ignition coil is used for igniting an ignition plug of an internal combustion engine. The ignition coil includes a center core, a primary coil, and a secondary coil. The primary coil includes a primary winding that is wound around a primary spool. The secondary coil includes a secondary winding that is wound around a secondary spool. Current, which is supplied to the primary coil, is shut, so that high voltage is generated in the secondary coil. Both ends of the primary winding and the secondary winding are respectively connected with predetermined terminals by welding. The number of turns of the secondary winding is much greater than the number of turns of the primary winding. The diameter of the secondary winding is much smaller than the diameter of the primary winding. Accordingly, the secondary winding, which is significantly small in diameter, is difficult to be connected with a small-diameter secondary terminal arranged on the high-voltage side.

A conventional connecting method of a coil wire, which is disclosed in JP-A-2003-45735, includes three processes.

As shown in FIGS. 8A, 8B, 9, a coil wire 81, which has an electrically insulative sheath, is wound around a secondary spool 80, and a wire end of the coil wire 81 is wound around a coil terminal 82, to which air is supplied from air nozzles 87 in the first process.

Arc is generated between the coil terminal 82 and an electrode 86 of a torch 85, so that heat is generated in the coil terminal 82, and the electrically insulative sheath is flashed from the coil wire 81 of a winding portion 83 in the first heating step of the second process.

Arc is generated between the coil terminal 82 and the electrode 86 of the torch 85, so that the coil terminal 82 is welded, and the coil terminal 82 is connected with the coil wire 81 of the winding portion 83 in the second heating step of the third process.

The object of the conventional connecting method is to remove the electrically insulative sheath and to connect the coil wire 81 with the coil terminal 82 using a simple method, in which the coil terminal 82 is heated in twice. The electrically insulative sheath is removed from the coil wire 81 in the first heating step, i.e., second process. The coil terminal 82 is welded in the second heating step, i.e., third process after removing the electrically insulative sheath of the coil wire 81.

When, a secondary wire is wound to a secondary terminal for a significantly large number of turns such as 20000 turns, the secondary terminal becomes thin. In this case, the diameter of the secondary wire becomes significantly small, such as 50 μm. The conventional connecting method may be applied to the thin secondary terminal, to which the secondary wire of significantly small-diameter is wound for a significantly large number of turns. In this case, degree of electric field increases, and stress concentration arises due to acute shape of the connecting portion, in which the secondary terminal and the secondary wire are welded. Accordingly, an electric tree may be formed and cracking may be caused in an electrically insulative resin located around the connecting portion, as thermal cycles, in which the secondary coil assembly is heated and cooled, is repeated.

In the conventional connecting method, the tip end of the connecting portion is in a bulb-shape, however, increase of electric field and cracking of the electrically insulative resin are not described. Besides, the number of turns of the secondary winding, the diameter of the secondary winding, and the electrically insulative resin around the connecting portion are not described. In the conventional connecting method, the number of turns of the secondary winding may be small, and the diameter of the secondary winding may be large according to the description of the structure. In this structure, the secondary terminal may be thick, and increase of electric field in the tip end of the connecting portion may not be a serious problem. However, voltage generated in the secondary coil may be low, when the number of the winding of the secondary coil is low. Besides, the heating process is divided into two processes in the conventional connecting method. Accordingly, the connecting process takes long, and manufacturing cost may be increased in the conventional connecting process.

SUMMARY OF THE INVENTION

In view of the foregoing problems, it is an object of the present invention to produce an ignition coil including a secondary coil assembly having a secondary winding of significantly small diameter, which is turned for a significantly large number, connected with a tip end of a thin secondary terminal, while generation of electric field in the secondary terminal is restricted, and an electrically insulative resin is protected from forming an electric tree and cracking.

It is another object of the present invention to produce an ignition coil, in which a terminal end of the secondary winding may be easily connected steadily with the tip end of the secondary terminal, even when the diameter of the secondary winding is significantly small, the number of turns of the secondary winding is significantly large, and the secondary terminal has a thin structure.

According to the present invention, an ignition coil includes a center core, a secondary coil, a primary coil, and an outer core. The secondary coil is arranged on the outer circumferential side of the center core. The secondary coil includes a secondary spool and a secondary winding. The secondary spool has a high voltage bracket that is arranged on an end portion of the secondary spool. The high voltage bracket includes a secondary terminal. The secondary winding is wound around the secondary spool. The primary coil is arranged on the outer circumferential side of the center core. The primary coil includes a primary spool and a primary winding. The primary winding is wound around the primary spool. The secondary coil and the primary coil are substantially coaxially arranged. The outer core is arranged on the outer circumferential side of one of the primary coil and the secondary coil that is arranged on the outer circumferential side with respect to the other of the primary coil and the secondary coil. The secondary terminal includes a first connecting portion, which has a bulb shape, in a tip end thereof. The first connecting portion connects with an end portion of the secondary winding of the secondary coil. The first connecting portion is covered with an electrically insulative resin.

A secondary coil assembly includes a secondary coil, in which a secondary winding is wound around a secondary spool, and a high voltage bracket. The high voltage bracket is arranged on an end side of the secondary spool. The high voltage bracket includes a secondary terminal that includes a metallic tip end portion and a first portion. A connecting method of a secondary coil assembly includes a winding process and a welding process.

In the winding process, an end portion of the secondary winding of the secondary coil is wound around the first portion. The first portion is arranged on the side of the secondary spool with respect to the metallic tip end portion, which is in a substantially bar-shape arranged on a side of a tip end of the secondary terminal. In the welding process, the metallic tip end portion of the secondary terminal is welded to form a first connecting portion in a substantially bulb shape, in which the end portion of the secondary winding of the secondary coil assembly is embedded, when the metallic tip end portion is solidified.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
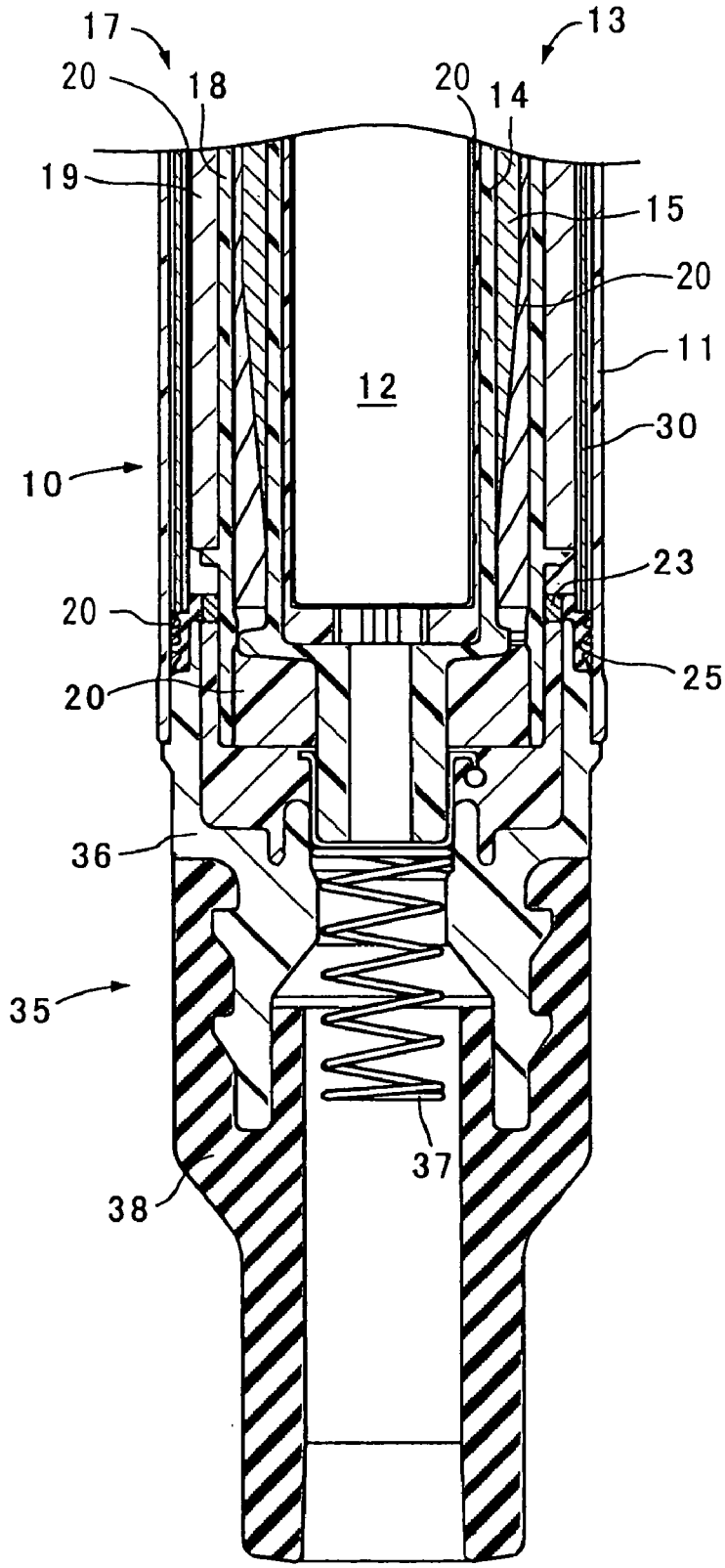
FIG. 1 is a partially cross-sectional side view showing an ignition coil according to a first embodiment of the present invention.

An ignition coil shown in FIG. 1 includes a coil portion 10, a high-voltage tower portion 35, and a control portion (not shown). The coil portion 10 is an axially intermediate portion of the ignition coil. The high-voltage tower portion 35 is located on the lower end side of the coil portion 10. The control portion is located on the upper end side of the coil portion 10. The coil portion 10 includes a case 11, a center core 12, a secondary coil assembly 13, a primary coil 17, and an outer core 30. The center core 12 is received in the case 11. The secondary coil assembly 13 is located on the radially outer side of the center core 12. The primary coil 17 is located on the radially outer side of the secondary coil assembly 13. The primary coil 17 includes a primary spool 18 and a primary winding 19. The primary winding 19 is wound around the primary spool 18.

Figure 2:
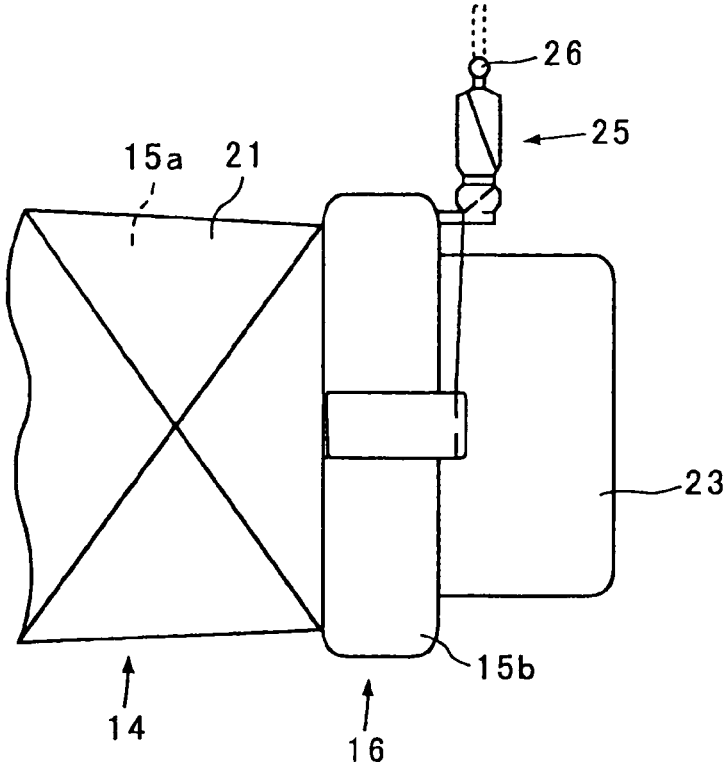
FIG. 2 is a side view showing a secondary coil assembly according to the first embodiment.
Figure 3:
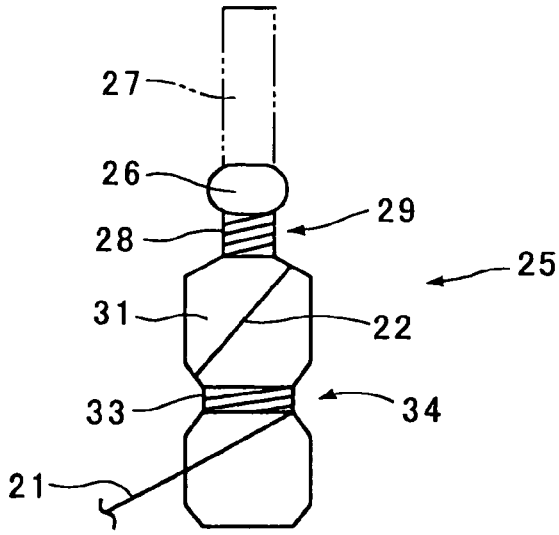
FIG. 3 is an enlarged side view showing the secondary terminal of the secondary coil according to the first embodiment.

As shown in FIGS. 1 to 3, the secondary coil assembly 13 includes a secondary coil 16 and a high voltage bracket 23 (FIG. 2). The secondary coil 16 includes a secondary spool 14 and a secondary winding 21. The secondary winding 21 is wound around the outer circumferential periphery of the secondary spool 14. The high voltage bracket 23 is connected with an end portion of the secondary spool 14. A secondary terminal 25 extends from the high voltage bracket 23, and the secondary terminal 25 is bent in the circumferential direction of the secondary spool 14. The secondary winding 21 has an end portion 22 (FIG. 3) that is connected with the secondary terminal 25. An electrically insulative resin 20 is filled into multiple gaps, such as a gap formed between the center core 12 and the secondary spool 14, a gap around the secondary winding 21 arranged between the secondary spool 14 and the primary spool 18, a gap around the primary winding 19 arranged between the primary spool 18 and the case 11, and a portion around the secondary terminal 25. The outer core 30 is arranged on the outer circumferential side of the primary coil 17.

As referred in FIG. 1, the high-voltage tower portion 35 has a cylindrical shape, and includes a tower case 36, a spring 37, and a plug cap 38. The tower case 36 is connected with the lower end of the coil portion 10. The spring 37 is received in the inner space formed in the tower case 36, such that the spring 37 resiliently connects with an ignition plug (not shown). The plug cap 38 is made of rubber, and is connected with the lower end of the tower case 36, such that the plug cap 38 electrically insulate the ignition plug.

As referred in FIGS. 2, 3, the secondary spool 14 includes a cylindrical body 15*a* that has a pair of collar portions 15*b* on both axial end sides. The secondary winding 21 is formed of a copper wire that is covered with an electrically insulative sheath. The secondary winding 21 is wound around a concavity formed axially between the collar portions 15*b*. The electrically insulative sheath of the secondary winding 21 is formed of thermostable urethane in consideration of circumstance of use of the ignition coil.

The high voltage bracket 23 is integrally formed with an end portion of the secondary spool 14. The secondary terminal 25 extends from the high voltage bracket 23 in the substantially radial direction. The end portion 22 of the secondary winding 21 connects with a part of the tip end of the secondary terminal 25. The secondary terminal 25 is made of phosphor bronze and is covered with an electrically insulative sheath.

Figure 4:
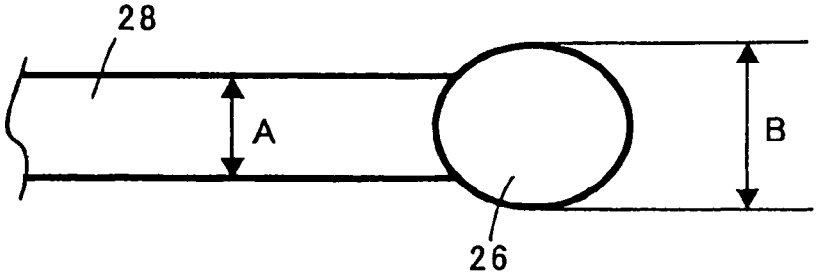
FIG. 4 is an enlarged schematic view showing a connecting portion and a tip metallic portion of the secondary terminal according to the first embodiment.

The tip end of the secondary terminal 25 has a substantially bulb-shaped connecting portion (first connecting portion) 26, a small-diameter main turn portion 29, a large-diameter portion 31, and a small-diameter dead turn portion 34 in the order from the side of the tip end of the secondary terminal 25. The end portion 22 of the secondary winding 21 is wound respectively around a first small-diameter portion (first portion) 28 and a second small-diameter portion 33, so that the main turn portion 29 and the dead turn portion 34 are formed. As shown in FIG. 4, the outer diameter B of the connecting portion 26 is substantially twice as the width A of the first small-diameter portion 28. The secondary winding 21 and the secondary terminal 25 are electrically connected with each other in the connecting portion 26 and the main turn portion 29. A bar-shaped portion (metallic tip end portion) 27, which is shown by a chain double-dashed line, protrudes from the first small-diameter portion 28. The bar-shaped portion 27 is welded using arc heating, and the end portion 22 of the secondary winding 21 is covered with the welded bar-shaped portion 27 in a process, in which the bar-shaped portion 27 solidifies. Thus, the substantially bulb-shaped connecting portion 26 and the main turn portion 29 are formed. The bar-shaped portion 27 is formed in a substantially square shape in cross-section, i.e., axial-section. Each side of the square shaped cross-section, i.e., transverse section of the bar-shaped portion 27 is substantially 0.3 mm. The diameter of the bulb-shaped connecting portion 26 is substantially 0.4 mm.

Figure 5:
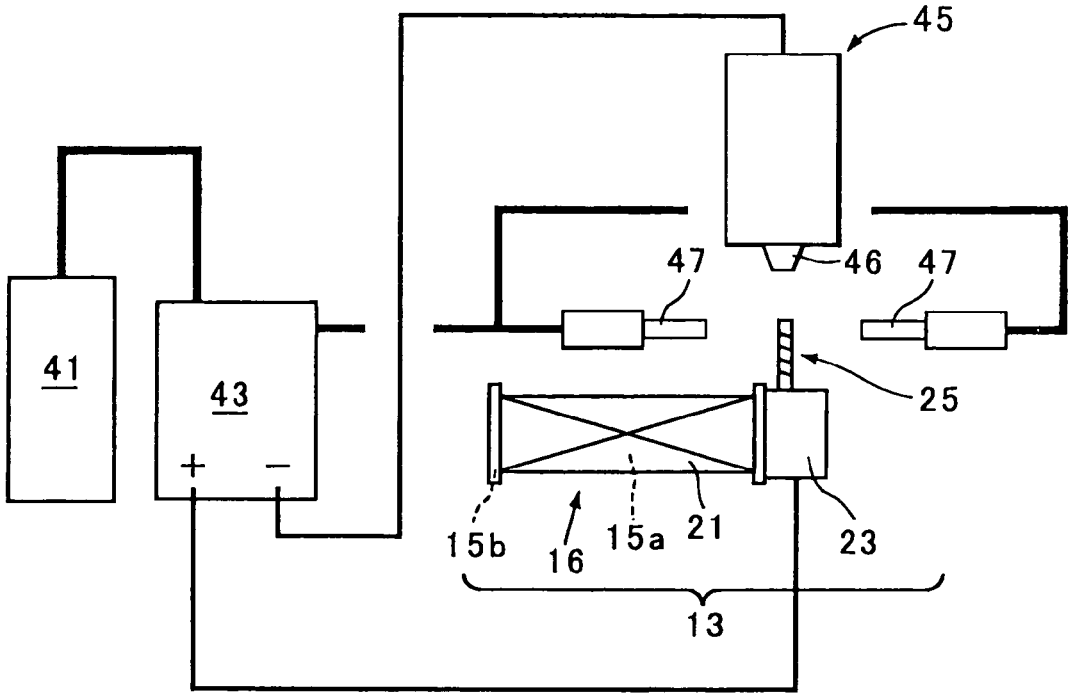
FIG. 5 is an over view showing an arc welding apparatus according to the first embodiment.

Next, a connecting process, in which the end portion 22 of the secondary winding 21 is connected with the secondary terminal 25 in the secondary coil assembly 13 using an arc welding apparatus, is described in reference to FIGS. 3 to 6. An arc welding apparatus shown in FIG. 5 is used for TIG welding. The arc welding apparatus includes an inert-gas supply portion 41, an electric power source 43, a torch 45, and a pair of air nozzles 47. Argon gas is supplied from the inert-gas supply portion 41 into the torch 45 that has an electrode 46 formed of tungsten. The electrode 46 is arranged on the tip end of the torch 45. The torch 45 and the high voltage bracket 23 are supplied with electric power from the electric power source 43, so that an arc is generated between the electrode 46 of the torch 45 and the secondary terminal 25 of the secondary coil assembly 13. The air nozzles 47 supply air for burning the electrically insulative sheath of the secondary winding 21 in the connecting portion 26 (FIG. 3).

First, the secondary winding 21 is wound around the secondary spool 14 (FIG. 2), to which the high voltage bracket 23 having the secondary terminal 25 is assembled, for substantially 20000 turns. The diameter of the secondary winding 21 is substantially 0.05 mm. The end portion 22 (FIG. 3) of the secondary winding 21 is wound around the first small-diameter portion 28 and the second small-diameter portion 33 of the secondary terminal 25, so that the main turn portion 29 and the dead turn portion 34 are formed. The total protruding length of both the bar-shaped portion 27 and the first small-diameter portion 28 is substantially 2.3 mm. The cross section of the bar-shaped portion 27 is a substantially square that has a dimension such as 0.3 mm×0.3 mm. That is, the bar-shaped portion 27 has the cross section, substantially 0.3 mm square. The above cross section and the protruding length of the bar-shaped portion 27 are determined such that the electrically insulative sheath of the secondary winding 21 is burned, and the secondary terminal 25 is melt by arc heating in the welding portion of the bar-shaped portion 27.

Figure 6:
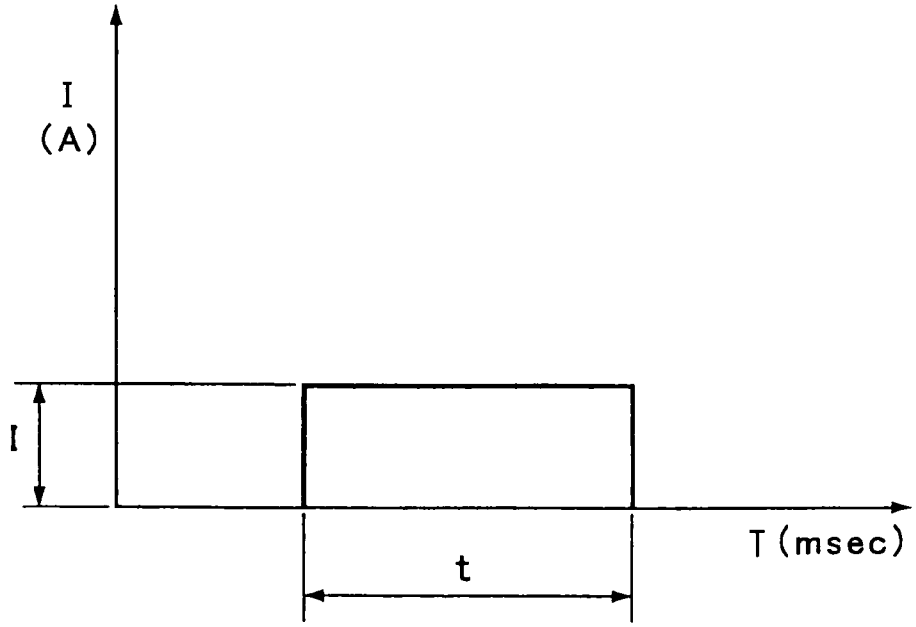
FIG. 6 is a graph showing a relationship between current and energizing time according to the first embodiment.

The electrode 46 of the torch 45 and the secondary terminal 25 of the secondary coil assembly 13 are opposed to each other to form a gap of 0.5 mm to 1.0 mm therebetween. As shown in FIG. 6, the torch 45 is supplied with a predetermined electricity I (A) for a predetermined period t (msec), while the electrode 46 is shielded, so that an arc is generated between the secondary terminal 25 and the electrode 46. The predetermined electricity I (A) is preferably 12 (A), and the period t (msec) is preferably 11 (msec).

Simultaneously, inert gas is supplied from the tip end of the torch 45, and a small amount of air is supplied from the air nozzles 47 to the melting potion of the bar-shaped portion 27 (connecting portion 26) such that the air does not affect the electrode 46. The angle and location of the air nozzles 47 are predetermined such that a small amount of air is supplied from the air nozzles 47 to only the connecting portion 26.

Thermal energy of arc generated between the electrode 46 and the secondary terminal 25 melts the bar-shaped portion 27 (FIG. 3) and a part of the first small-diameter portion 28 of the secondary terminal 25, so that the electrically insulative sheath of the secondary winding 21 flashes, i.e., instantaneously sublimes. The end portion 22 of the secondary winding 21 is tucked into the melting material of the bar-shaped portion 27, so that the bulb-shaped connecting portion 26 is formed in the process, in which the melting material is solidified. Subsequently, the secondary terminal 25 is bent in the circumferential direction of the secondary spool 14 within a predetermined inner diameter such that the secondary coil assembly 13 can be inserted into the cylindrical inner space of the primary coil 17. The electrically insulative resin 20 is filled in the secondary coil assembly 13, and the connecting portion 26 is covered with the electrically insulative resin 20. Thus, the secondary coil assembly 13 is manufactured.

The connecting portion 26, in which the end portion 22 of the secondary winding 21 is connected with the tip end (metallic tip end portion) of the secondary terminal 25, is formed in a bulb-shape in the above ignition coil, so that an edge portion can be reduced in the connecting portion 26. Electric field is apt to increase in the edge portion in a thermal cycle, in which the connecting portion 26 (bar-shaped portion 27) is heated and cooled, and stress concentration is apt to arise in the edge portion. The edge portion can be reduced in the connecting portion 26, so that starting point of cracking can be reduced in the electrically insulative resin 20 around the connecting portion 26, i.e., the electrically insulative resin 20 can be protected from cracking. According to a calculation result of electric field, a degree of electric field is reduced by substantially 25% in the bulb-shaped connecting portion 26 in this embodiment compared with a connecting portion 26 having an edge-shaped tip end.

Besides, the cross section of the bar-shaped portion 27 is substantially square, so that the bulb-shaped connecting portion 26 can be steadily connected with the main turn portion 29, and the shape of the bulb-shaped connecting portion 26 easily become stable. The total length of the main turn portion 29, which is melt and solidified, and the connecting portion 26 can be uniformly low within substantially 1.2 mm to 1.4 mm.

When the connecting portion 26 is cooled and solidified, the connecting portion 26 may contract, and the secondary winding 21 may be pulled to the side of the connecting portion 26. Besides, the secondary winding 21 may be stretched due to thermal stress because of difference between the linear thermal expansion coefficient of the copper wire and that of the electrically insulative sheath of the secondary winding 21. In this situation, the secondary winding 21 may be disconnected from the connecting portion 26. On the contrary in the above structure, the dead turn portion 34 is formed on the root side, i.e., side of the secondary spool 14 with respect to the main turn portion 29 in the secondary terminal 25, so that the length of the secondary winding 21 has a margin, i.e., flexibility. Therefore, the secondary terminal 25 can be protected from disconnecting.

In the above connecting method, the end portion 22 of the secondary winding 21 can be easily and steadily connected with the tip end of the secondary terminal 25, even the secondary winding 21 has a significantly small diameter such as 0.05 mm, and the secondary terminal 25 has a small cross section, 0.3 mm square.

The reason is, first, the cross-section of the tip end of the bar-shaped secondary terminal 25 is a substantially square, and each side of the substantially square shaped cross-section of the tip end of the bar-shaped secondary terminal 25 is substantially 0.3 mm.

Second, the material of the secondary winding 21 is copper that is sheathed with electrically insulative urethane. The material of the secondary terminal 25 is phosphor bronze. In this combination of the materials, difference of temperature between when the secondary terminal 25 is melt and when the secondary terminal 25 is solidified becomes substantially 180° C., so that the connecting portion 26 is apt to be a substantially bulb shape, i.e., a substantially spherical shape.

Third, the electrically insulative sheath of the secondary winding 21 is flashed substantially simultaneously with melting of the bar-shaped portion 27 of the secondary terminal 25, so that connecting process can be completed within one-step. As referred in FIG. 6, the torch 45 may be supplied with the predetermined electricity I (A) for the predetermined period t (msec). Thus, an additional process and an additional treatment for removing the electrically insulative sheath of the secondary winding 21 can be reduced.

In this structure, the number of the turns of the secondary winding 21 of the secondary coil 16 is significantly large, the diameter of the secondary winding 21 is significantly small, and the tip end of the bar-shaped portion 27 of the secondary terminal 25 is thin. Specifically, the number of the turns of the secondary winding 21 is in a range from substantially 10000 to substantially 30000. The diameter of the secondary winding 21 is in a range from substantially 40 μm to substantially 60 μm. The substantially bulb-shaped connecting portion 26, in which the end portion 22 of the secondary winding 21 of the secondary coil 16 is at least partially welded, is substantially 0.4 mm in radius. Even in this structure, the secondary winding 21 can be stably connected with the connecting portion 26 without disconnecting in the ignition coil.

The diameter of the connecting portion 26 is preferably greater than the width of the tip end of the bar-shaped portion 27 and the thickness of the tip end of the bar-shaped portion 27. That is, the diameter of the connecting portion 26 is preferably greater than the width of the first small-diameter portion 28 and the thickness of the first small-diameter portion 28. Specifically, the diameter of the connecting portion 26 is preferably greater than the width of the cross section of the first small-diameter portion 28 and the thickness of the cross section of the first small-diameter portion 28.

The diameter of the connecting portion 26 set to be large, so that the connecting portion 26 becomes in a bulb shape that is greater than the thickness and the width of the tip end of the bar-shaped portion 27, i.e., first small-diameter portion 28. Thus, increase of electric field and stress concentration can be restricted in the connecting portion 26, i.e., the tip end of the bar-shaped portion 27. Furthermore, the outer diameter of the connecting portion 26 is preferably 1.2 to 2.5 times of the width of the tip end of the bar-shaped portion 27 and the thickness of the tip end of the bar-shaped portion 27.

The connecting method of the secondary coil assembly 13 includes a winding process and a welding process. The connecting method of the secondary coil assembly 13 is significantly effective when the connecting method is applied to the high-voltage side, i.e., the side of the ignition plug in the secondary coil assembly 13. The connecting method of the secondary coil assembly 13 can be applied to the low-voltage side, i.e., the opposite side as the ignition plug in the secondary coil assembly 13.

The end portion 22 of the secondary winding 21 of the secondary coil 16 is wound around the tip end of the bar-shaped portion 27 of the secondary terminal 25 in the winding process. The tip end of the bar-shaped portion 27 is formed of metal.

The bar-shaped portion 27 has at least the tip end, which is to be welded, and the first small-diameter portion 28, to which the end portion 22 of the secondary winding 21 is wound, before the tip end of the bar-shaped portion 27 is welded and connected with the secondary winding 21. The total length of the tip end and the first small-diameter portion 28 of the bar-shaped portion 27 can be within substantially 2.0 mm to 2.6 mm. Furthermore, the second small-diameter portion 33 may be provided to the root side, i.e., side of the secondary spool 14 with respect to the first small-diameter portion 28 in the secondary terminal 25. A portion of the secondary winding 21, which extends from the end portion 22 of the secondary winding 21 to the side of the secondary spool 14, is wound around the second small-diameter portion 33 to be the dead turn portion 34.

The tip end of the secondary terminal 25 is welded, so that the connecting portion 26 is formed. Alternatively, a part of the tip end and the first small-diameter portion 28 of the secondary terminal 25 are welded with each other, so that the connecting portion 26 is formed. The cross-section of the tip end of the secondary terminal 25 and the like is determined such that an acute portion is not formed in the connecting portion 26 after welding. The cross-section of the tip end of the secondary terminal 25 may be a substantially rectangular shape such as a substantially square and an orthogonal shape, a substantially regular polygonal shape, and a substantially circular shape. When the cross-section of the tip end of the secondary terminal 25 is a substantially rectangular shape, the aspect ratio between the length and the width of the cross section may be in a range from substantially 1:1 to substantially 1:5. The aspect ratio between the length and the width of the cross section is preferably in a range from substantially 1:1 to substantially 1: 2. In this structure, the tip end of the bar-shaped portion 27 and the secondary winding 21 can be stably connected with each other in the secondary terminal 25. When the cross-section of the tip end of the secondary terminal 25 is a substantially square, each side of the substantially square may be within substantially 0.3 mm to 0.5 mm.

The material of the secondary winding 21 and the secondary terminal 25 of the secondary coil 16 is determined such that an acute portion is not formed in the connecting portion 26 after welding. A typical material of the secondary winding 21 is copper, and a typical material of the electrically insulative sheath of the secondary winding 21 is urethane. The material of the electrically insulative sheath of the secondary winding 21 may be polyester or ester imide. The material of the secondary terminal 25 is copper (pure copper) or a copper alloy, specifically, phosphor bronze (Cu, Sn, or phosphorous), bronze (Cu, Al, Ni, or Mn), or cupronickel (Cu or Ni). The material of the secondary terminal 25 may be an alloy of copper and zinc, pure copper, oxygen free copper, a bronze-type material, or a cupronickel-type material. The secondary terminal 25 is preferably covered with an electrically insulative sheath. Alternatively, a terminal body formed of copper and zinc may be coated with tin, for example.

The tip end of the secondary terminal 25 is welded using arc welding or the like, so that the connecting portion 26 is formed in the welding process. Alternatively, a part of the tip end and the first small-diameter portion 28 of the secondary terminal 25 are welded using arc welding or the like with each other, so that the connecting portion 26 is formed in the welding process. The end portion 22 of the secondary winding 21 of the secondary coil 16 is embedded in the substantially bulb-shaped connecting portion 26 in the process, in which the welded portion is solidified, in the welding process. The arc welding apparatus includes the inert-gas supply portion 41, the torch 45, and the air nozzles 47 and the like.

TIG (tungsten inert gas) welding, in which an arc is generated between the electrode 46 and the secondary terminal 25 in an atmosphere of inert gas such as argon-gas, can be used as a typical arc welding.

The metallic tip end of the secondary terminal 25 is welded, such that the metallic tip end does not form any acute portion. Typical shape of the metallic tip end is a substantially bulb-shape, i.e., a substantially spherical shape or a substantially globe shape. However, the shape of the metallic tip end is not limited to the substantially bulb-shape, and the shape of the metallic tip end may be a shape that is similar to a substantially bulb-shape such as a round shape or a substantially oval shape. The length of the connecting portion 26 that is formed on the tip end of the secondary terminal 25 may be within substantially 1.2 mm to 1.4 mm.

(Variation)

At least a portion of the initial turns in the end portion 22 of the secondary winding 21 is preferably incompletely melt in the connecting portion 26, instead of the above structure, in which all the turns of the end portion 22 of the secondary winding 21 is completely melt in the connecting portion 26. Specifically, the end portion 22 of the secondary winding 21 has a tip end that is embedded in the connecting portion 26, and the tip end of the end portion 22 is at least partially intermediately welded in the connecting portion 26. Alternatively, the tip end of the end portion 22 is at least partially unwelded in the connecting portion 26. Specifically, the predetermined electricity I (A) and the period t (msec) are controlled in the welding process, so that the welding condition of the secondary winding 21 in the connecting portion 26 can be controlled.

When a portion of the initial turns, i.e., embedded portion in the end portion 22 of the secondary winding 21 is not completely melt in the connecting portion 26, the portion of the initial turns of the secondary winding 21 has a different structure from the other portion of the connecting portion 26. In this structure, a boundary face is formed between a portion of the secondary winding 21, in which the secondary winding 21 is incompletely melted, and the connecting portion 26, so that tense of the secondary winding 21 can be loosened in the connecting portion 26, and the secondary winding 21 may be protected from disconnection. As a result, the secondary winding 21 is not apt to be torn even high tension is applied to the end portion 22 of the secondary winding 21.

The main component of the end portion 22 of the secondary winding 21 is copper, and the copper is not diffused, i.e. not deposited in the surface of the connecting portion 26 in the above structure. Alternatively, the secondary winding 21 and the connecting portion 26 may be welded such that copper, i.e., copper content of the secondary winding 21 is deposited by substantially 50% to 70% in the surface of the connecting portion 26. The main component (content), i.e., copper of the secondary winding 21 is preferably deposited in the surface of the connecting portion 26, so that the tip end of the bar-shaped portion 27 and the secondary winding 21 can be stably connected with each other in the secondary terminal 25. Besides, the color of the main component, i.e., copper is different from the color of the connecting portion 26, so that existence, i.e., welding of copper can be visually confirmed.

Specifically, the predetermined electricity I (A) and the period t (msec) are controlled in the welding process, so that the welding condition of the secondary winding 21 in the connecting portion 26 can be controlled.

Insulative sheath of the secondary winding 21 is burned, and combustion gas is generated in the welding process. The number of turns of the winding in the bulb-shaped connecting portion 26, i.e., the number of turns of the secondary winding 21 wound around the bar-shaped portion 27, which is formed to be the connecting portion 26, may be large. However, when the number of turns of the winding is large, an amount of combustion gas of the insulative sheath of the secondary winding 21 becomes large in the welding process. The combustion gas may blow welding metal away, and the combustion gas may form a number of blowholes in the bulb-shaped connecting portion 26. In this case, both the structure and the shape of the bulb-shaped connecting portion 26 may be inappropriate. Therefore, the number of turns of the winding in the connecting portion 26 is preferably equal to or greater than 1, and is preferably equal to or less than 10. The number of turns of the winding in the connecting portion 26 is more preferably equal to or greater than 2, and is more preferably equal to or less than 5.

One of the primary coil 17 and the secondary coil 16 may be arranged on the inner side, and the other of the primary coil 17 and the secondary coil 16 may be arranged on the outer side.

(Second Embodiment)

Figure 7:
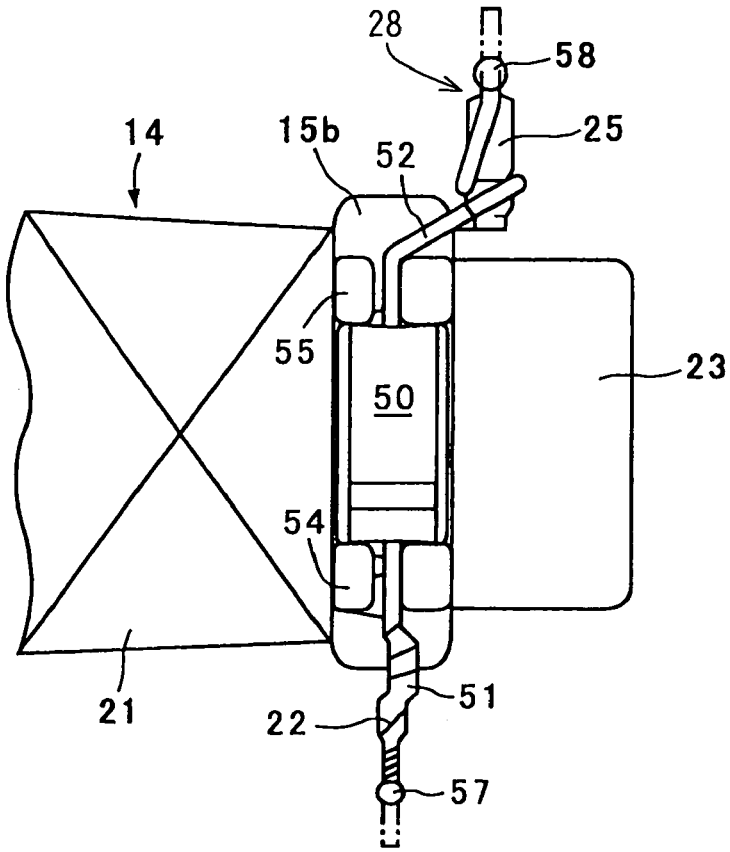
FIG. 7 is a schematic side view showing a secondary coil assembly according to a second embodiment of the present invention.
Figure 9:
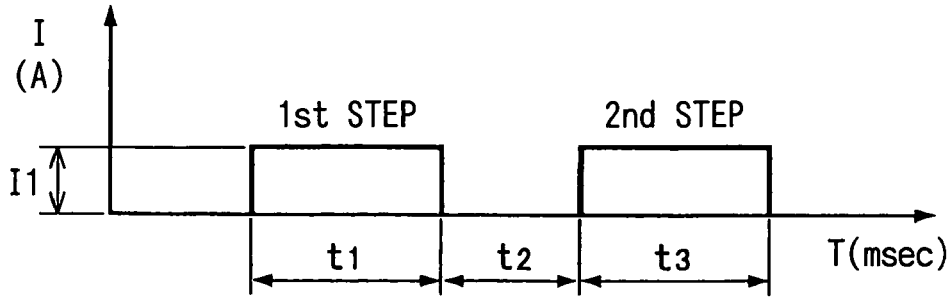
FIG. 9 PRIOR ART
FIG. 9 is a graph showing a relationship between current and energizing time according to a prior art.
Figure 8A:
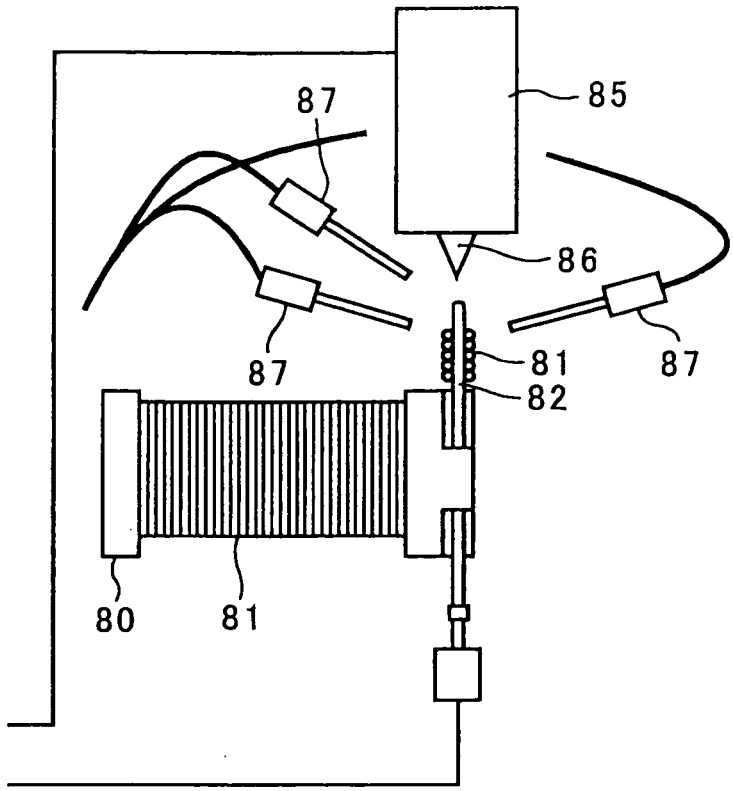
FIG. 8A PRIOR ART
FIG. 8A is an over view showing an arc welding apparatus.
Figure 8B:
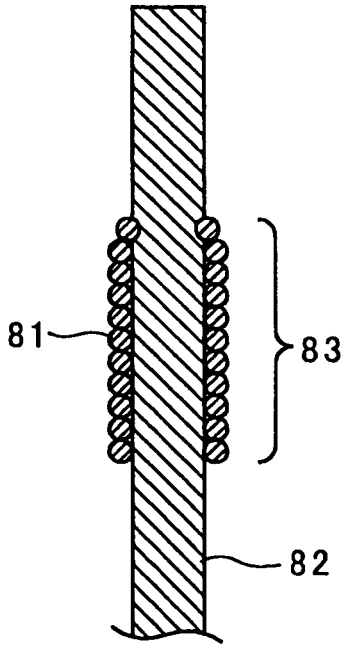
FIG. 8B PRIOR ART
FIG. 8B is a cross-sectional enlarged side view showing a coil wire wound around a coil terminal according to a prior art.

The ignition coil shown in FIG. 7 has a high-voltage diode 50 in addition to the above structure of the secondary coil assembly 13 in the first embodiment. The high-voltage diode 50 is arranged on the high-voltage side between the end portion 22 of the secondary winding 21 and the secondary terminal 25 for restricting ON-voltage. Specifically, a pair of lead wires 51, 52 of the high-voltage diode 50 is positioned along two protrusions 54, 55 that are provided to the collar portion 15*b* of the secondary spool 14.

The lead wire (first lead wire) 51 of the high-voltage diode 50 is connected with the end portion 22 of the secondary winding 21 via a connecting portion (second connecting portion) 57 using arc welding. The lead wire (second lead wire) 52 of the high-voltage diode 50, which is arranged on the opposite side as the lead wire 51 with respect to the high-voltage diode 50, is connected with the secondary terminal 25, specifically, the tip end (bar-shaped portion 27) of the secondary terminal 25 using arc welding.

The end portion 22 of the secondary winding 21 of the secondary coil 16 is D1 in diameter. The tip end of the secondary terminal 25 is D2 in diameter. Each lead wire 51, 52 of the high-voltage diode 50 is D3 in diameter. When the diameters D1, D2, D3 are compared, the diameter D1 of the end portion 22 of the secondary winding 21 is the smallest of the diameters D1, D2, D3. The diameter D2 of the tip end of the secondary terminal 25 and the diameter D3 of the lead wires 51, 52 of the high-voltage diode 50 are equivalent to each other, in general. Therefore, the end portion 22 of the secondary winding 21 can be connected with the lead wire 51 of the high-voltage diode 50 via the connecting portion 57 in a bulb-shape. Besides, the lead wire 52 of the high-voltage diode 50 can be connected with the tip end of the secondary terminal 25 via a bulb-shaped connecting portion (first connecting portion) 58.

Next, the connecting method of the second embodiment is described. The high voltage bracket 23 having the secondary terminal 25 is assembled to the secondary spool 14. The secondary winding 21, which is substantially 0.05 mm in diameter, is wound around the secondary spool 14 for substantially 20000 turns. The lead wires 51, 52 of the high-voltage diode 50 are attached into the two protrusions 54, 55 provided to the collar portion 15*b* of the secondary spool 14. In this situation, a main turn portion and a dead turn portion are formed in the lead wire 51, such that the secondary winding 21 can be wound around the main turn portion and the dead turn in the same manner as that of the first embodiment. The end portion 22 of the secondary winding 21 is wound around the lead wire 51 of the high-voltage diode 50, subsequently the connecting portion 57 is formed using arc welding, so that the secondary winding 21 and the lead wire 51 are connected with each other. The lead wire 52 of the high-voltage diode 50 is wound around the secondary terminal 25, subsequently the connecting portion 58 is formed using arc welding, so that the lead wire 52 and the secondary terminal 25 are connected with each other.

The torch 45 is supplied with a predetermined electricity for a predetermined period, while the electrode 46 is shielded. Simultaneously, inert gas is supplied from the tip end of the torch 45, and a small amount of air is supplied from the air nozzles 47 to the melting potion of the connecting portions 57, 58 in arc welding, in the same manner as that of the first embodiment. Subsequently, the lead wires 51, 52 of the high-voltage diode 50 and the secondary terminal 25 are respectively bent in the circumferential direction of the secondary spool 14 within the predetermined inner diameter, such that the secondary coil assembly 13 can be inserted into the cylindrical inner space of the primary coil 17. Thus, the secondary coil assembly 13 is manufactured.

The high-voltage diode 50 may be arranged on the low-voltage side of the secondary coil assembly 13. Even in this structure, the same effect can be produced.

When the primary coil 17 is energized, ON-voltage is induced in the secondary coil 16. In this situation, preignition is apt to be caused in the engine. However, the high-voltage diode 50 is arranged between the end portion 22 of the secondary winding 21 and the secondary terminal 25, so that ON-voltage can be restricted or prevented from being induced in the secondary coil 16, and preignition can be restricted from arising in the engine.

Besides, the lead wire 51 of the high-voltage diode 50 can be easily connected with the end portion 22 of the secondary winding 21 steadily via the connecting portion 57 that has a substantially bulb-shape. Besides, the lead wire 52 of the high-voltage diode 50 can be easily connected with the tip end of the secondary terminal 25 steadily via the connecting portion 58 that has a substantially bulb-shape. The above effect is obtained by using difference of diameters and difference of the materials of all the end portion 22 of the secondary winding 21, the lead wires 51, 52 of the high-voltage diode 50, and the bar-shaped portion 27, i.e., tip end of the secondary terminal 25.

Thus, the high-voltage diode 50, which is inserted between the secondary winding 21 and the secondary terminal 25, restricts or prevents from inducing ON-voltage in the secondary coil 16 when the energizing of the primary coil 17 is stopped, so that preignition can be restricted from being caused in the engine.

Various modifications and alternations may be diversely made to the above embodiments without departing from the spirit of the present invention.

What is claimed is:

1. An ignition coil comprising:

a center core;

a secondary coil that is arranged on an outer circumferential side of the center core, the secondary coil including:

a secondary spool having a high voltage bracket that is arranged on an end portion of the secondary spool, the high voltage bracket including a secondary terminal; and a secondary winding that is wound around the secondary spool;

a primary coil that is arranged on an outer circumferential side of the center core, the primary coil including:

a primary spool; and a primary winding that is wound around the primary spool, wherein the secondary coil and the primary coil are substantially coaxially arranged; and an outer core that is arranged on an outer circumferential side of one of the primary coil and the secondary coil that is arranged on an outer circumferential side with respect to the other of the primary coil and the secondary coil, wherein the secondary terminal includes a first connecting portion, which has a bulb shape, in a tip end thereof, the first connecting portion connects with an end portion of the secondary winding of the secondary coil, the first connecting portion is covered with an electrically insulative resins, the secondary terminal further includes a first portion that connects with the first connecting portion, the first portion arranged on a side of the secondary spool with respect to the first connecting portion, the first connecting portion has a diameter that is greater than a width of a cross section of the first portion, and the diameter of the first connecting portion is greater than a thickness of the cross section of the first portion.

2. The ignition coil according to claim 1, wherein the secondary terminal further includes a second portion that is arranged on a side of the secondary spool with respect to the first portion, the secondary winding of the secondary coil has a portion, which extends from the end portion of the secondary winding to a side of the secondary spool, and the portion of the secondary winding, which extends from the end portion to the side of the secondary spool, is wound around the second portion.

3. The ignition coil according to claim 1, wherein the diameter of the first connecting portion is substantially twice as the width of the cross section of the first portion, and the diameter of the first connecting portion is substantially twice as the thickness of the cross section of the first portion.

4. The ignition coil according to claim 3, wherein the diameter of the first connecting portion is substantially 0.4 mm.

5. The ignition coil according to claim 1, wherein the end portion of the secondary winding has a tip end that is embedded in the first connecting portion, and the tip end of the end portion of the secondary winding is at least partially intermediately welded in the first connecting portion.

6. The ignition coil according to claim 1, wherein the end portion of the secondary winding has a tip end that is embedded in the first connecting portion, and the tip end of the end portion of the secondary winding is at least partially unwelded in the first connecting portion.

7. The ignition coil according to claim 1, wherein the secondary winding is wound around the secondary spool for a number of turns that is equal to or greater than 10000 and is equal to or less than 30000, and the secondary winding has a diameter that is equal to or greater than 40 μm and is equal to or less than 60 μm.

8. The ignition coil according to claim 1, further comprising:

a diode that includes a first lead wire having a second connecting portion, which has a substantially bulb shape, wherein the end portion of the secondary winding of the secondary coil is connected with the first connecting portion of the secondary terminal via the diode, and the end portion of the secondary winding of the secondary coil is connected with the second connecting portion of the first lead wire of the diode.

9. The ignition coil according to claim 8, wherein the diode includes a second lead wire that is connected with the first connecting portion of the secondary terminal.

10. The ignition coil according to claim 1, wherein the secondary winding of the secondary coil is formed of a copper wire that is covered with an electrically insulative sheath.

11. The ignition coil according to claim 10, wherein the copper wire of the secondary winding contains copper content that is deposited by substantially 50% to 70% in a surface of the connecting portion.

12. The ignition coil according to claim 1, wherein the secondary terminal is formed of one of pure copper and a copper alloy.

13. The ignition coil according to claim 12, wherein the secondary terminal is formed of one of phosphor bronze, bronze, cupronickel, an alloy of copper and zinc, pure copper, and oxygen free, and the electrically insulative sheath of the secondary winding is formed of one of urethane, polyester, and ester imide.

14. The ignition coil according to claim 1, wherein the first portion of the secondary terminal is substantially rectangular in cross section, which has an aspect ratio in a range from substantially 1:1 to substantially 1:5.

15. A connecting method of a secondary coil assembly, the secondary coil assembly including a secondary coil, in which a secondary winding is wound around a secondary spool, and a high voltage bracket, the high voltage bracket arranged on a side of an end portion of the secondary spool, the high voltage bracket including a secondary terminal that includes a metallic tip end portion and a first portion, the connecting method comprising the steps of:

winding an end portion of the secondary winding of the secondary coil around the first portion that is arranged on a side of the secondary spool with respect to the metallic tip end portion, which is in a substantially bar-shape arranged on a side of a tip end of the secondary terminal in a winding process; and welding the metallic tip end portion of the secondary terminal to form a first connecting portion in a substantially bulb shape, in which the end portion of the secondary winding of the secondary coil assembly is embedded, when the metallic tip end portion is solidified in a welding process, wherein the first portion connects with the first connecting portion, the first portion is arranged on a side of the secondary spool with respect to the first connecting portion, the first connecting portion has a diameter that is greater than a width of a cross section of the first portion, and the diameter of the first connecting portion is greater than a thickness of the cross section of the first portion in the welding process.

16. The ignition coil according to claim 15, wherein the secondary winding is wound around the secondary spool for a number of turns that is equal to or greater than 10000 and is equal to or less than 30000, and the secondary winding has a diameter that is equal to or greater than 40 μm and is equal to or less than 60 μm.

17. The connecting method according to claim 15, wherein the secondary winding of the secondary coil is formed of a copper wire that is covered with an electrically insulative sheath in the winding process.

18. The connecting method according to claim 17, wherein the copper wire of the secondary winding contains copper content that is deposited by substantially 50% to 70% in a surface of the connecting portion in the welding process.

19. The connecting method according to claim 15, wherein the secondary terminal is formed of one of pure copper and a copper alloy in the winding process.

20. The connecting method according to claim 19, wherein the secondary terminal is formed of one of phosphor bronze, bronze, cupronickel, an alloy of copper and zinc, pure copper, and oxygen free copper, in the winding process, and the electrically insulative sheath of the secondary winding is formed of one of urethane, polyester, and ester imide, in the winding process.

21. The connecting method according to claim 15, wherein the metallic tip end portion of the secondary terminal is substantially rectangular in cross section, which has an aspect ratio in a range from substantially 1:1 to substantially 1: 5 in the winding process.

22. The connecting method according to claim 15, wherein the secondary terminal further includes a second portion that is arranged on a side of the secondary spool with respect to the first portion, the secondary winding of the secondary coil has a portion, which extends from the end portion of the secondary winding to a side of the secondary spool, and the portion of the secondary winding, which extends from the end portion to the side of the secondary spool, is wound around the second portion in the winding process.

23. The connecting method according to claim 15, wherein the end portion of the secondary winding has a tip end that is embedded in the first connecting portion, and the tip end of the end portion of the secondary winding is at least partially intermediately welded in the first connecting portion in the welding process.

24. The connecting method according to claim 15, wherein the end portion of the secondary winding has a tip end that is embedded in the first connecting portion, and the tip end of the end portion of the secondary winding is at least partially unwelded in the first connecting portion in the welding process.

25. The connecting method according to claim 15, wherein the electrically insulative sheath of the secondary winding is at least partially flashed when the metallic tip end portion of the secondary terminal is welded in the welding process.

26. The ignition coil according to claim 15, wherein the diameter of the first connecting portion is substantially twice as the width of the cross section of the first portion, and the diameter of the first connecting portion is substantially twice as the thickness of the cross section of the first portion in the welding process.

27. The ignition coil according to claim 26, wherein the diameter of the first connecting portion is substantially is substantially 0.4 mm in the welding process.

* * * * *